US009956611B2

(12) United States Patent
Sterkenburg

(10) Patent No.: US 9,956,611 B2
(45) Date of Patent: May 1, 2018

(54) METHOD AND A DEVICE FOR MANUFACTURING A CUTTING INSERT GREEN BODY

(71) Applicant: SECO TOOLS AB, Fagersta (SE)

(72) Inventor: Dirk Sterkenburg, Gustafs (SE)

(73) Assignee: SECO TOOLS AB, Fagersta (SE)

( * ) Notice: Subject to any disclaimer, the term of this patent is extended or adjusted under 35 U.S.C. 154(b) by 0 days. days.

(21) Appl. No.: 15/303,652

(22) PCT Filed: Mar. 20, 2015

(86) PCT No.: PCT/EP2015/055877

§ 371 (c)(1),
(2) Date: Oct. 12, 2016

(87) PCT Pub. No.: WO2015/158492

PCT Pub. Date: Oct. 22, 2015

(65) Prior Publication Data

US 2017/0043397 A1 Feb. 16, 2017

(30) Foreign Application Priority Data

Apr. 16, 2014 (EP) ..... 14164869

(51) Int. Cl.
*B22F 3/03* (2006.01)
*B30B 15/30* (2006.01)
(Continued)

(52) U.S. Cl.
CPC ..... *B22F 3/03* (2013.01); *B30B 15/022* (2013.01); *B30B 15/304* (2013.01); *B22F 2005/001* (2013.01)

(58) Field of Classification Search
CPC .... B22F 3/03; B22F 2005/001; B30B 15/022; B30B 15/304
(Continued)

(56) References Cited

U.S. PATENT DOCUMENTS 6,318,986 B1 * 11/2001 Hinzmann ..... B22F 3/03 425/352
7,731,488 B2 * 6/2010 Smilovici ..... B22F 3/03 425/330
(Continued)

FOREIGN PATENT DOCUMENTS

WO 0056487 A1 1/2000
WO 2006080002 A1 8/2006

*Primary Examiner* — Joseph S Del Sole
*Assistant Examiner* — Thu Khanh T Nguyen
(74) *Attorney, Agent, or Firm* — Corinne R. Gorski

(57) ABSTRACT

A device for manufacturing a cutting insert green body by compacting a powder includes a die having an upper die part and a lower die, an upper punch and a lower punch, at least one of which is moveable along a pressing axis in relation to the die. The upper and lower die parts, when joined, define a die cavity that defines the shape of the green body to be formed by the compaction. At least one of the lower and upper die part has a pressing bore extending from the cavity for receiving the lower and upper punch. The upper die part has an upper surface that, at least in one direction, extends rectilinearly, and the upper die part has an upper opening in the upper surface, through which the upper punch is arranged to be forwarded into the cavity.

14 Claims, 7 Drawing Sheets

(51) Int. Cl.
*B30B 15/02* (2006.01)
*B22F 5/00* (2006.01)

(58) Field of Classification Search
USPC ..... 425/78, 330, 348 S, 352, 356, 443; 419/38, 66
See application file for complete search history.

(56) References Cited

U.S. PATENT DOCUMENTS

| | | | | |
|---|---|---|---|---|
| 8,062,014 | B2 * | 11/2011 | Gubanich ..... | B22F 3/03 425/330 |
| 2009/0263527 | A1 * | 10/2009 | Smilovici ..... | B22F 3/03 425/78 |
| 2012/0003443 | A1 | 1/2012 | Gubanich et al. | |

* cited by examiner

METHOD AND A DEVICE FOR MANUFACTURING A CUTTING INSERT GREEN BODY

RELATED APPLICATION DATA

This application is a § 371 National Stage Application of PCT International Application No. PCT/EP2015/055877 filed Mar. 20, 2015 claiming priority of EP Application No. 14164869.1, filed Apr. 16, 2014.

TECHNICAL FIELD

The present invention relates to a method of compacting a powder into a cutting insert green body, such that said cutting insert green body obtains a barrel-shape having a parting line on the outer peripheral surface thereof which is at least partially non-perpendicular to a pressing axis along which said compacting is performed, said method comprising the steps of: providing a compaction tool comprising a die that comprises an upper die part and a lower die part, and an upper punch and a lower punch, wherein the upper and lower die parts, when joined together, contribute to defining a die cavity that is delimited by an inner peripheral surface that defines the shape of the outer peripheral surface of the barrel-shaped green body to be formed by said compaction, said method further comprising the steps of providing either of the lower die part or the upper die part with a pressing bore extending from said cavity, for the lower punch or the upper punch to be received in in connection to said compacting.

The invention also relates to a device for manufacturing a cutting insert green body by compacting a powder, said device comprising; a die that comprises an upper die part and a lower die part that are separable from each other, and an upper punch and a lower punch, at least one of which is moveable along a pressing axis in relation to the die, wherein the upper and lower die parts, when joined, contribute to defining a die cavity that is delimited by an inner peripheral surface that defines the shape of the outer peripheral surface of the green body to be formed by said compaction, and wherein said inner peripheral surface of the die cavity is designed such that the green body obtains a barrel-shape having a parting line on the outer peripheral surface thereof which at least partially is non-perpendicular to said pressing axis, and wherein at least one of the lower die part and the upper die part has a pressing bore extending from said cavity, for the lower punch or the upper punch to be received in.

The invention relates to the technical field in which cutting inserts, preferably to be used for the machining of metal by milling, drilling or turning or by similar chip forming methods, are produced from a powder which is compacted into a green body and then subjected to a sintering process in which the compacted green body is further densified. Typically, the sintered body is then provided with a suitable wear resistant coating, such as a carbide, nitride, carbonitride, oxide, or boride with any suitable contemporary technique, such as physical vapour deposition or chemical vapour deposition.

It should be understood that a parting line as referred to herein is a line along which the barrel-shaped green body presents its maximum extension in a radial direction as seen from the a centre line of the green body. Preferably, said centre line is parallel with and coincident with the pressing axis.

It should also be understood that the die must not be restricted to being comprised only by the mentioned die parts, but that further die parts may be provided, and that the mentioned die parts may be further subdivided into further subparts thereof.

The compacted cutting insert green body is, typically, subjected to a sintering process in order to complete the production of a cutting insert on basis thereof.

BACKGROUND OF THE INVENTION

According to prior art, barrel-shaped cutting inserts may be formed by means of a process which includes that barrel-shaped green bodies are formed in a compaction device that comprises a die that is divided in an upper die part and a lower die part. The die parts are surrounded by an outer die part or a press table having a generally flat upper surface. When joined together, the upper die part and the lower die part define a chamber which defines the outer peripheral surface of the green body to be formed. Normally, the lower die part comprises a pressing bore extending from the lower surface thereof to said chamber, and the upper die part comprises a pressing bore that extends from an upper surface thereof to said chamber. There is also provided an upper punch arranged to slide through the upper pressing bore, and a lower punch arranged to slide through the lower pressing bore. During compaction, the respective punches are forwarded through the respective pressing bores such that the ends thereof reach said chamber and contribute to the definition of the outer peripheral surface of the green body by defining the opposite upper and lower surfaces thereof.

Prior to the compaction step, the upper die part is retracted or held in a retracted position in relation to the lower die part. The lower punch is retracted or held in a retracted position in the pressing bore provided in the lower die part. An upper surface of the lower die part is exposed as a consequence of the retraction of the upper die part. The exposed upper surface of the lower die part is in alignment with the upper surface of the surrounding press table, thereby enabling a powder filling device to be forwarded on said upper surfaces of the press table and the lower die part to a position in which it is enabled to introduce a powder into the part of the chamber defined by the lower die part, which defines an opening in said upper surface. Since the lower punch is retracted, powder is also introduced in the part of the pressing bore of the lower die part that is not occupied by the lower punch. After completion of the powder filling step, the powder filling device is retracted and the upper die part is forwarded to and joined with the lower die part. The compaction step is then performed by forwarding the lower and upper punch respectively to a position in which they, together with the inner walls of the respective die parts, define the shape of the green body to be formed. Finally, the upper die part is once again retracted, together with the upper punch, and the lower punch is further forwarded upwards in the direction of the pressing axis until the green body is fully exposed. Preferably the lower punch is forwarded until the upper surface thereof is in alignment with the upper surface of the lower die part. Thereby, a green body removal device, e.g. a robot arm, is enabled to remove the green body, and the main steps of the compaction sequence are finished.

The upper surface of the lower die part is flat, thereby enabling alignment with the upper surface of the press table and enabling the powder filling device to slide thereon and to fit tightly on top of and around the opening in said upper surface of the lower die part. Thereby, the risk of having powder escaping to the upper surface of the lower die part is efficiently suppressed. Powder remaining on the upper surface of the lower die will have a negative impact on the sealing between the upper and lower die parts and should therefore be avoided.

However, the above design is primarily suitable for the compaction of a barrel-shaped green body that has a parting line that is perpendicular to the pressing axis of the punches, and/or extends in one plane only. An upper inner edge of the lower die part extends along a line defining the parting line of the green body, and so does a lower inner edge of the upper die part. Should the parting line have a different than planar extension, the upper surface of the lower die part will have a contour corresponding to the contour of the parting line and will not be flat. This fact will make sliding of the powder filling device difficult due the fact that part of the lower die part will project from the plane defined by the upper surface of the outer die part or press table. If the contour is such that parts of the upper surface around said opening is below the level of the rest of said upper surface, it will be difficult to prevent powder from being gathered at those parts of the upper surface during powder filling. Such powder will have a negative impact on the sealing between the lower and the upper die parts.

THE OBJECT OF THE INVENTION

It is an object of the present invention to present a new and alternative method and a device for producing a cutting insert green body, wherein the green body to be produced has a barrel-shape with a parting line which is not planar and/or not perpendicular to the pressing axis and wherein a die used therefore comprises two die parts the inner peripheral surface of which, when joined together, define an outer peripheral surface of the green body. The invention shall enable efficient and reliable filling of powder into the die regardless of the fact that the parting line is non-planar and/or not perpendicular to the pressing axis.

SUMMARY OF THE INVENTION

The object of the invention is obtained by means of the initially defined method, characterized in that it comprises the steps of providing the lower die part with an upper inner edge that extends along a line defining the parting line of the green body, providing the upper die part with a lower inner edge that extends along a line defining the parting line of the green body, providing the upper die part with an upper surface that, at least in one direction, extends rectilinearly, providing the upper die part with an upper opening in said upper surface, through which the upper punch is enabled to be forwarded to said cavity, positioning the upper die part above the lower die part such that the lower inner edge of the upper die part is contiguously arranged in relation to the upper inner edge of the lower die part, positioning the upper punch in a retracted position relative the upper opening of the upper die, filling powder into the die through said upper opening in the upper surface of the upper die part, compacting the powder by forwarding at least the upper punch towards said cavity, retracting the upper punch, exposing the green body by retracting the upper die part from the lower die part.

It is not crucial in which order the upper punch and the upper die part are retracted from the lower die part in order to expose the green body and make the latter accessible for a device for the removal of the green body. In order to fully expose the compacted green body, the lower punch is forwarded upwards further through the lower die part. This motion may take place simultaneously with the retraction of the upper punch, such that the compacted green body is held between the two punches during displacement thereof out of the lower die part. Preferably, the upper die part is separable from the lower die part in the direction of the pressing axis and, preferably, separation is achieved by retraction of the upper die part upwards from the lower die part. The term "contiguously" as well as the term "coincide" as used here and hereinafter does not necessarily mean that there is a physical contact between edges or surfaces that are contiguously arranged or coincide. However, preferably, a sealing effect, preventing powder from leaking into any space between such edges and surfaces is achieved as an effect of such coincidence.

Preferably, said method comprises the step of providing a powder-filling device and positioning it on top of said upper opening in the upper die part or removing it from said position by enabling it to slide on said upper surface of the upper die in said direction in which said surface extends rectilinearly. Thereby the use of a sliding powder-filling device is enabled. Preferably, in the direction in which the upper surface of the upper die extends rectilinearly, said surface extends in a direction perpendicular to the pressing axis. Preferably, the surface that extends rectilinearly extends rectilinearly from a position laterally offset from said upper opening to said upper opening, corresponding to a conceived sliding path of a powder-filling device.

According to another embodiment the upper die part is retracted from the lower die part through a rectilinear motion of at least one of said upper die part and lower die part in the direction of the pressing axis.

The object of the invention is also achieved by the initially mentioned device, characterized in that the lower die part has an upper inner edge that extends along a line defining the parting line of the green body, the upper die part has a lower inner edge that extends along a line defining the parting line of the green body, the upper die part has an upper surface that, at least in one direction, extends rectilinearly, and that the upper die part has an upper opening in said upper surface, through which the upper punch is enabled to be forwarded to said cavity.

The provision of an upper surface of the upper die that, at least in one direction, extends rectilinearly, and the upper opening therein, enables a powder filling device to be positioned on top of said opening by a lateral rectilinear sliding motion, for the purpose of filling powder into the die. The upper surface of the upper die extends rectilinearly in a direction from a lateral position on the surface to the opening therein, thereby enabling a powder filling device to be slid along said rectilinearly extending surface from a lateral position to a position on top of said opening. The rectilinearly extending surface includes the area around said opening.

According to one embodiment, the lower die part has an upper surface which is delimited by said upper inner edge and which, from a centre axis of said cavity parallel with the pressing axis, extends in a lateral direction from said upper inner edge, and that the upper die part has a lower surface which is delimited by said lower inner edge thereof and which, from said centre axis, extends in a lateral direction, wherein at least parts of the upper surface of the lower die part and the lower surface of the upper die part are in bearing contact with each other when the upper and lower die parts are joined and the lower inner edge of the upper die part and the upper inner edge of the lower die part are contiguously arranged in relation to each other and the inner cavity is defined. Thereby, bearing surfaces are not only defined by said upper and lower edges respectively, but also by said parts of the upper and lower surfaces of the lower and upper die parts respectively that bear against each other, thereby contributing to a more stable design. The upper and lower edges may not even be in direct contact with each other and, in the case that there is a compressive load pressing the die parts against each other, such load may be adopted by said parts of the surfaces and not by the edges. Such an embodiment might even be preferred, since it prevents damage of the edges caused by compressive load on the latter.

According to one embodiment, said upper and lower surfaces have corresponding extension and are in bearing contact with each other along the whole area thereof when the upper and lower dies are joined and the lower inner edge of the upper die part and the upper inner edge of the lower die part are contiguously arranged and the inner cavity is defined. Thereby, a stable and steady engagement between the upper and lower die parts is promoted.

According to one embodiment, the upper surface of the upper die part is flat. Thereby, a powder-filling device is enabled to be positioned on top of said opening in the upper surface of the upper die part by a sliding motion in any direction on said upper surface.

According to yet another embodiment, the upper surface of the upper die part extends in a plane perpendicular to the pressing axis.

According to yet another embodiment, the die comprises an outer die part that at least partially laterally encloses the upper and lower die parts when those are joined. The outer die part may be connected to the lower die part and form a part thereof.

Preferably, the outer die part has an upper surface that is arranged to be contiguously arranged in relation to the upper surface of the upper die part when the latter is joined with the lower die part and the device is set for filling of powder into said cavity. In other words, the upper surfaces of the upper die part and the outer die part are in alignment and in close proximity to each other, at least partly, and preferably such that, in the aforementioned direction in which the upper surface of the upper die part extends rectilinearly, the upper surface of the outer die part is in alignment with the upper surface of the upper die part. Thereby, a powder-filling device is enabled to slide on the upper surface of the outer die part and on the upper surface of the upper die part from one of said surfaces to the other without being hindered by any level difference between said upper surfaces.

According to one embodiment, the upper die part is displaceable in the direction of the pressing axis in relation to the outer die part.

According to one embodiment, the device according to the invention comprises a powder-filling device, arranged to slide on said upper surface of the upper die part in said at least one direction in which the upper surface extends rectilinearly, to and from a powder-filling position on top of said upper opening of the upper die.

According to one embodiment, the upper die part presents an extension which is connected to an actuator by means of which a displacement of the upper die part in the direction of the pressing axis is enabled. The extension is positioned such that it does not prevent a powder filling device from sliding to and from said opening in the upper surface of the upper die part in a direction in which the upper surface extends linearly. Furthermore, the extension is positioned and designed such that it does not prevent a robot or the like from removing the compacted green body when the latter is in its exposed position. The extension may either extend upwards to an actuator located above the upper die part or downwards to an actuator located below the lower die part.

According to one embodiment, the cutting insert green body, the outer peripheral surface of which is defined by the inner peripheral surface of the die cavity, presents an upper end, a lower end and a waist between said upper end and lower end, and, in at least one radial direction as seen from a centre axis of the cutting insert green body, the waist has a lateral extension that is larger than the corresponding lateral extension of the cutting insert green body anywhere from the waist to the upper end of the cutting insert green body and anywhere from the waist to the lower end of the cutting insert green body. Typically, the waist defines the maximum width of the cutting insert green body, and the width of the cutting insert tapers from the waist towards the respective upper and lower ends of the cutting insert. The waist need not extend further laterally than the rest of the cutting insert body in all radial directions, but at least in some radial directions, such that a sector is defined, for which the waist has a larger lateral extension than the rest of the cutting insert green body. Typically, the waist has a larger lateral extension than the rest of the cutting insert green body in all lateral directions, i.e. for a sector of 360°. A lateral extension is referred to as an extension cross wise to the centre axis of the cutting insert green body extending from the upper end to the lower end of the cutting insert green body. The waist may defined by a line or a zone running circumferentially around the body.

The invention also relates to a cutting insert, characterized in that it is formed from a green body produced in a device according to the invention.

Further features and advantages of the invention will be disclosed in the following detailed description of exemplifying embodiments of the invention.

BRIEF DESCRIPTION OF THE DRAWINGS

Hereinafter, embodiments of the present invention will be described in detail with reference to the annexed drawing, on which.

DETAILED DESCRIPTION OF THE INVENTION

Figure 1A:
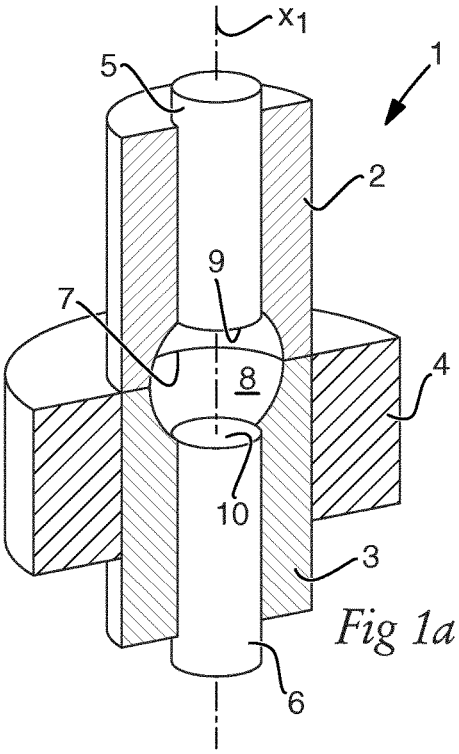
FIG. 1*a* is a schematic representation of essential parts of a compaction device according to prior art, in a powder-compaction position.

FIG. 1 is schematic representation of essential parts of a device according to prior art for compaction of a powder into a cutting insert green body, wherein the cutting insert green body to be formed is barrel-shaped in the meaning that it has a waist that is located between opposite ends of the cutting insert green body and that defines a maximum width of the cutting insert green body. The device comprises a die 1 that is subdivided in an upper die part 2, a lower die part 3 and an outer die part 4. There is also provided an upper punch 5 and a lower punch 6 that are received in punch channels in the respective die part 2, 3 as known per se. The upper die part 2 and the lower die part 3 are separated by a parting line 7 which is perpendicular to a pressing axis $x_1$ along which the upper punch 5 and the lower punch 6 are arranged to move. The punches 5, 6 are used for the purpose of compacting a powder introduced into a cavity 8 defined by the upper die part 2 and the lower die part 3 when joined together and by the opposing ends 9, 10 of the punches 5, 6. There could be arranged a core pin, preferably coinciding with the pressing axis $x_1$ and extending through the lower die part 3 into and through the cavity 8. Such a core pin would then be arranged for the purpose of generating a centre hole in the cutting insert green body. The outer die part 4 may be provided as a fixed table or the like. The punches 5, 6 and the upper and lower die parts 2, 3 are connected to actuators (not shown) by means of which they are individually movable in the direction of the pressing axis $x_1$. Which parts that are the movable ones is a matter of choice for the person skilled in the art. Normally, however, the lower die part is a fixed part, while the punches and the upper die part are the movable ones.

Figure 1B:
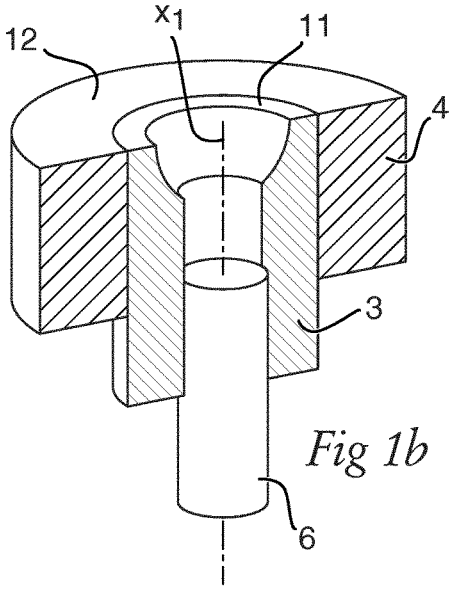
Fig 1b Prior Art
FIG. 1*b* is a representation corresponding to that of FIG. 1*a*, but showing the same device in a position in which the device is set for powder-filling.

The waist of the cutting insert green body to be formed is regular in the sense that it extends in a plane perpendicular to a centre axis of the cutting insert green body to be formed. The centre axis of the green body, when confined by the die 1, coincides with or is parallel with the aforementioned pressing axis $x_1$ of the punches 5, 6. Thus, the parting plane between the upper die part and the lower die part is perpendicular to the pressing axis $x_1$. FIG. 1*b* shows the device according to FIG. 1*a* in a position in which it is set for filling of powder into the lower die part 3. The upper die part 2 and the upper punch 5 have been retracted upwards such that they are not visible in FIG. 1*b*, and the upper surface 11 of the lower die part 3, which is flat, is in alignment with an upper surface 12 of the outer die part 4. In this position, the lower punch is retracted downwards such that extra space is generated in the lower die part 3 for the purpose of enabling the lower die part 3 to receive the amount of powder required to form the aimed cutting insert green body. Since the parting line 7 is perpendicular to the pressing axis the upper surface 11 of the lower die part 3 can be made flat. Thereby, a powder-filling device can be slid on said upper surfaces 11, 12 to a powder filling position on top of the upper surface 11 of the lower die part 3.

Figure 2A:
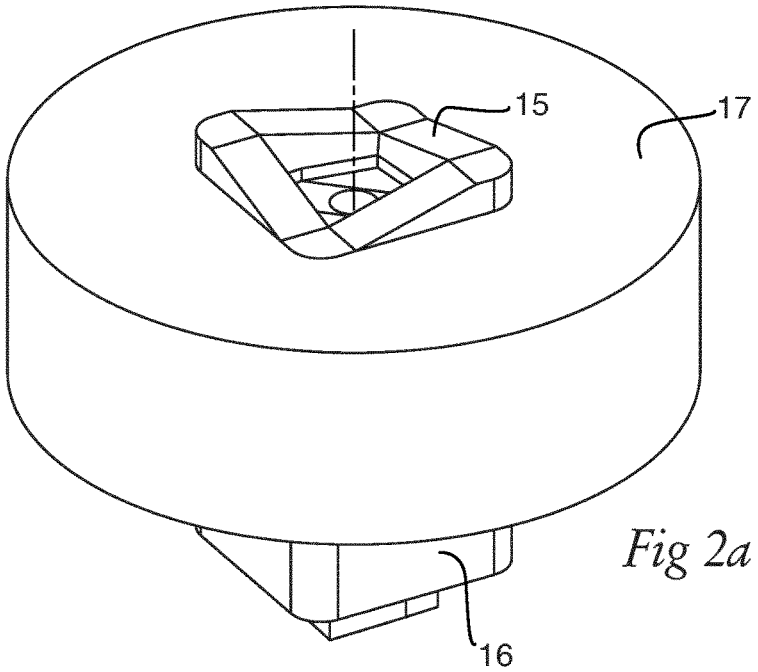
FIG. 2*a* is a schematic representation of parts of a compaction device, showing the hypothetical case in which a green body having a waist line on the outer peripheral surface thereof which is at least partially non-perpendicular to the pressing axis is to be compacted.
Figure 2B:
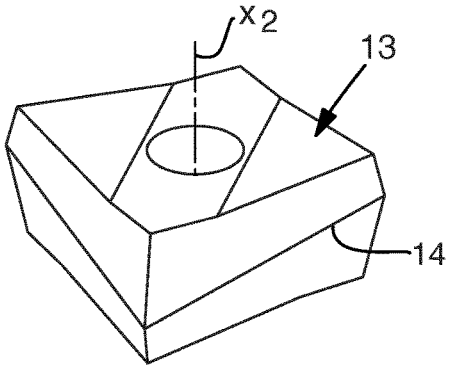
FIG. 2*b* is an exemplifying embodiment of a barrel-shaped cutting insert green body to be compacted in the hypothetical case shown in FIG. 2*a*.
Figure 2C:
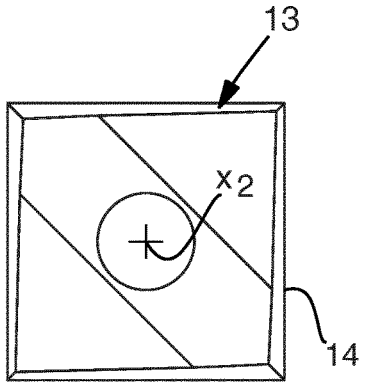
FIG. 2*c* is a top view of the green body shown in FIG. 2*b*.
Figure 2D:
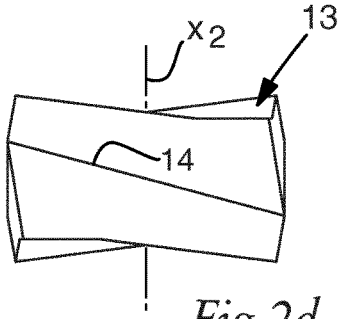
FIG. 2*d* is a side view of the green body shown in FIGS. 2*b* and 2*c*.

FIG. 2*a* shows parts of a compaction device as set for powder-filling, showing a case in which a cutting insert green body, that has a parting line on the outer peripheral surface thereof which is at least partially non-perpendicular to the pressing axis, is to be compacted. The cutting insert green body to be formed is further shown in FIGS. 2*b*-2*d* and indicated with 13. As can be seen, this cutting insert green body 13 has a parting line 14 that is irregular in the sense that is at least partly non-perpendicular to the centre axis $x_2$ of the cutting insert green body. Nor does the parting line extend in in one plane only. The die 1 is designed such that centre axis $x_2$ coincides with or is parallel with the pressing axis of the punches of the compaction device. As a result of the design of the cutting insert green body, the upper surface 15 of the lower die 16 does not extend in one plane, but presents a wave-like extension. If no specific measure is taken, and the same principle as the one shown in FIG. 1*b* is applied during powder-filling, the lower die part 16 will form an obstacle that projects upwards relative the upper surface 17 of an outer die part and prevents a powder-filling device from being slid thereon to a filling position on top of the lower die part 16. Accordingly, filling of the die with powder gets more complicated. The present invention, as described hereinafter with reference to FIGS. 3*a*-3*i*, 4*a*-4*c* and 5*a*-5*d* aims at solving the above-mentioned problem in connection to the compaction of barrel-shaped cutting insert bodies having a waist line or parting line that is at least partly non-perpendicular to the centre axis of the cutting insert body and thus to the pressing axis of the punch or punches used for said compaction.

Figure 3A:
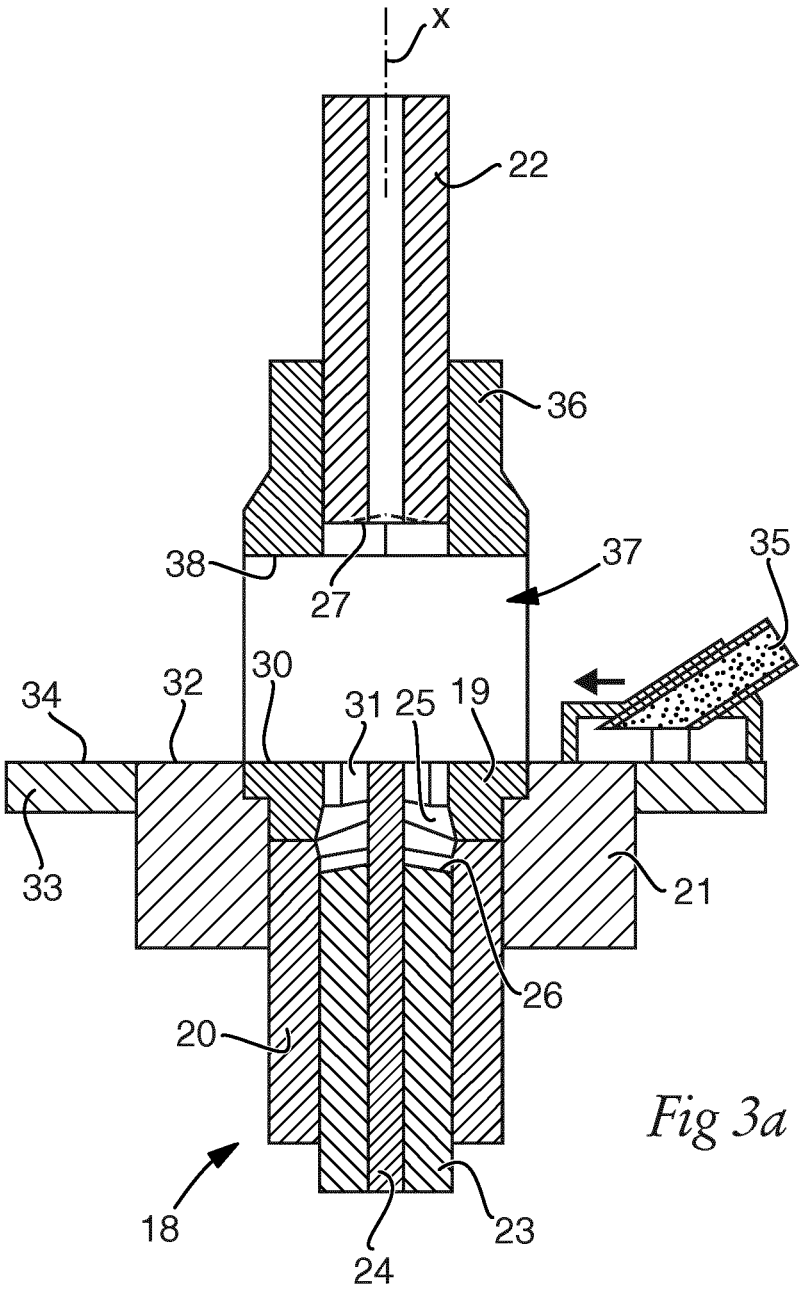
FIGS. 3*a*-3*i* is a series of figures showing the succeeding steps of the method according to one embodiment of the present invention for compacting a cutting insert green body by means of an embodiment of a compaction device according to the present invention, as seen in cross-section.

FIG. 3*a* shows a first embodiment of a compaction device according to the invention. FIGS. 3*a*-3*i* show essential steps of an embodiment of the method according to the invention for compacting of a powder to a cutting insert green body. FIGS. 4*a*-4*c* is a further elucidation of the device according to the first embodiment, in perspective, showing the device in positions corresponding to FIGS. 3*a*, 3*f*, and 3*i*. The cutting insert green body has a shape corresponding to the shape of the body disclosed with reference to FIGS. 2*b*-2*d*. Therefore, the cutting insert green body is hereinafter given reference number 13 whenever mentioned. The compaction device comprises a die 18 comprising an upper die part 19, a lower die part 20 and an outer die part 21. The outer die part 21 may be more of a table than a die part. However, it may have a supporting function relative the upper and lower die parts 19, 20 and may therefore be defined as part of the die 18. It may, alternatively, be connected to the lower die part 19 and form a single unit together with the latter.

Further, the compaction device comprises an upper punch 22 and a lower punch 23. The upper punch 22 extends longitudinally in and is movable in the direction of a pressing axis x. The lower punch 23 extends longitudinally in and is movable in the direction of a pressing axis that does, but need not, coincide with the pressing axis x of the upper punch 22. The respective punches 22, 23 are connected to a respective actuator, not shown, by means of which their movement in the direction of the pressing axis x is accomplished. Through the lower punch 23, in the direction of the pressing axis x, a core pin 24 extends. The core pin 24 is connected to a further actuator, not shown, by means of which it is moved in the direction of the pressing axis x. It should be understood that other provisions of one or more core pins, or no use thereof at all, is also within the scope of the present invention. It should also be understood that there may be further punches provided and/or that the upper and lower punches may be subdivided into further punches.

The lower die part 20 defines part of a die cavity 25 that defines the final shape of the cutting insert green body 13 to be compacted. The lower die part 20 also presents a bore that extends from said die cavity 25 to a lower surface of the lower die part 20 and through which the lower punch 23 is introduced into the lower die part 20. The bore has an inner peripheral surface corresponding to the outer peripheral surface of the lower punch 23 and defines a guiding bore through which the lower punch 23 can be advanced towards said cavity 25 or retracted therefrom. An upper end surface 26 of the lower punch 23 contributes to the definition of said die cavity 25 when the lower punch is advanced to a final compaction position, as shown in FIG. 3*f*.

The upper die part 19 defines a further part of the die cavity 25 that defines the final shape of the cutting insert green body 13 to be compacted. The die cavity 25 is completely defined once the upper die part 19 is joined to the lower die part 20 and the upper punch 22 is advanced to its final compaction position and the lower punch 23 is advanced to its final compaction position. The final compaction position is shown in FIG. 3*f*. A lower end surface 27 of the upper punch 22 thereby also contributes to the defining of the die cavity 25. While the upper die part 19 and the lower die part 20 define the lateral delimitation of the die cavity 25, the lower end surface 27 of the upper punch 22 and the upper end surface 26 of the lower punch 23 define the opposite ends of the die cavity 25 in the longitudinal direction thereof, i.e. in the direction of the pressing axis x.

The cutting insert green body to be compacted has the geometry as described with reference to FIGS. 2*a*-2*d*. In order to make the peripheral surface of the die cavity 25 correspond to such a geometry, the lower die part 20 has an upper inner edge 28 that extends along a line defining the parting line 14 of the green body 13 and the upper die part 19 has a lower inner edge 29 that extends along a line defining the parting line 14 of the green body 13. The lower die part 20 has an upper surface 44 which is delimited by said upper inner edge 28 and which, from a centre axis of said cavity parallel with the pressing axis x, extends in a lateral direction from said upper inner edge 28 to an outer edge 45 (see FIG. 4*c*). The upper die part 19 has a lower surface 46 which is delimited by said lower inner edge 29 thereof and which, from said centre axis, extends in a radial direction to an outer edge 47, wherein at least parts of the upper surface 44 of the lower die 20 and the lower surface 46 of the upper die part 19 are in bearing contact with each other when the upper and lower die parts 19, 20 are joined and the lower inner edge 29 of the upper die part 19 and the upper inner edge 28 of the lower die part 20 are contiguously arranged and the inner cavity 25 is defined. Here, the upper and lower surfaces 44, 46 have corresponding extension and they are in bearing contact with each other along the whole area thereof when the upper and lower die parts 19, 20 are joined and the lower inner edge 29 of the upper die part 19 and the upper inner edge 28 of the lower die part 20 are contiguously arranged and the inner cavity 25 is defined.

The upper die part 19 presents an upper surface 30 which is generally flat and extends in a plane that is perpendicular to the pressing axis x. In the upper surface 30 of the upper die part 19 there is provided an opening 31. The opening 31 is provided for receiving the upper punch 22 when the latter is advanced to its final compaction position and defines the beginning of a punch tunnel through which the punch is advanced. The outer die part 21 comprises an upper surface 32, which is generally flat. Around the outer die part 21 there is also provided a table 33 that has an upper surface 34. It should be stated that the provision of both an outer die part 21 and a table 33 is not a necessity. Depending on the function and design of the outer die part 21, the latter may be regarded as a table rather that a die part. In such a case, it might also happen that any further table, like table 33, is not included in the compacting device.

For the purpose of filling powder into the die cavity 25 during a powder-filling step, the compaction device also comprises a powder-filling device 35. The powder-filling device 35 is arranged so as to slide on the upper surfaces 30, 32 of the upper die part 19 and the outer die part 21 respectively and, possibly, also on the upper surface 34 of the table 33 to and from a position on top of the opening 31 in the upper surface 30 of the upper die part 19. In order to enable such sliding, the upper surfaces 30, 32 of the upper die part 19 and the outer die part 21 respectively, and preferably also the upper surface 34 of the table 33, are in alignment with each other when the upper die part 19 is in a position ready for powder-filling. This position is shown in FIG. 3*a* as well as in FIG. 4*a*. In the position in which the compaction device is ready for powder-filling, the upper die part 19 is positioned on top of the lower die part 20 such that that the lower inner edge 29 of the upper die part 19 is contiguously arranged in relation to the upper inner edge 28 of the lower die part 20. The lower punch 23 is in a retracted position relative its final compaction position, for the purpose of enabling receipt of sufficient amount of powder to be compacted in the die 18. However, depending on the design of the upper die part 19, more precisely the length and width of the punch tunnel defined therein for the receipt of the upper punch 22, the need of retraction of the lower punch 23 might be different. The upper punch 22 is, however, in a retracted position relative the upper opening 31 of the upper die part 19 for the purpose of enabling the powder-filling device 35 to reach its powder-filling position on top of the opening 31 in the upper surface 30 of the upper die part 19.

In order to make the upper die part 19 be conveniently connected to an actuator for moving the upper die part 19 in the direction of the pressing axis x, the upper die part 19 presents an upper extension 36 which extends above said upper surface 30, and there is space 37 between said upper surface 30 of the upper die part 19 and an opposite lower surface 38 of the upper extension 36 thereof, and there is a lateral opening into said space enabling the powder-filling device 35 to be slid to or from the upper opening 31 of the upper die part 19 through said lateral opening. The upper extension 36 is connected to an actuator, not shown, for moving the upper die part in the direction of the pressing axis x. In the present embodiment, the upper extension 36 also defines a punch channel for guiding the upper punch 22. However, it should be stated that such a punch channel is only an optional feature of the compaction device according to the invention.

FIGS. 3*b*-3*i* shows the consecutive steps during compaction of a cutting insert green body by means of the device shown in FIGS. 3*a* and 4*a*-4*c*.

Figure 3B:
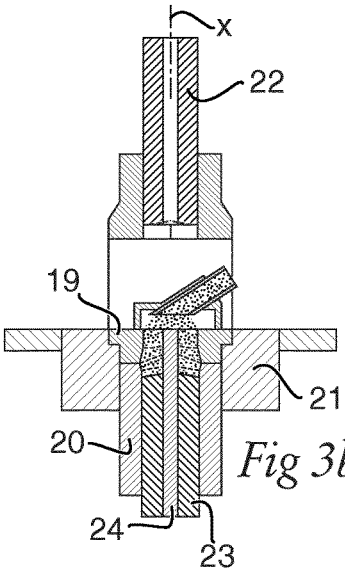
Figure 3F:
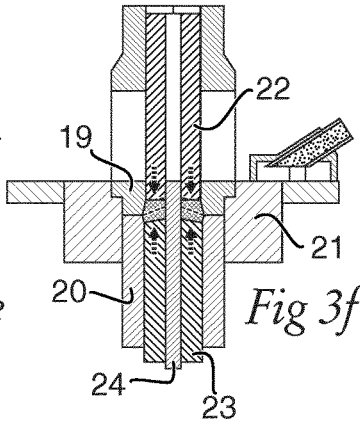
Figure 4A:
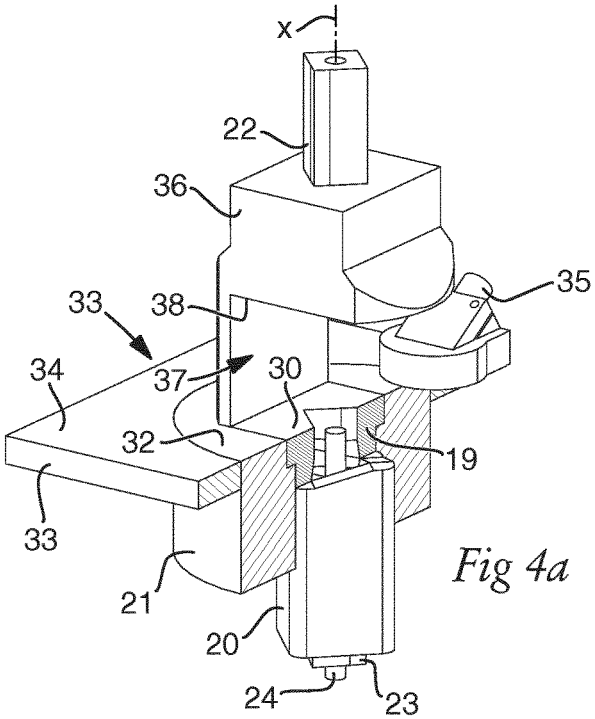
FIGS. 4*a*-4*c* is partly cut perspective views of the device according to the present invention, corresponding to FIGS. 3*a*, 3*f* and 3*i*, FIGS. 5*a*-5*d* show an alternative embodiment of a device according to the present invention in positions corresponding to those shown in FIGS. 3*a*, 3*b*, 3*f* and 3*i*.
Figure 4B:
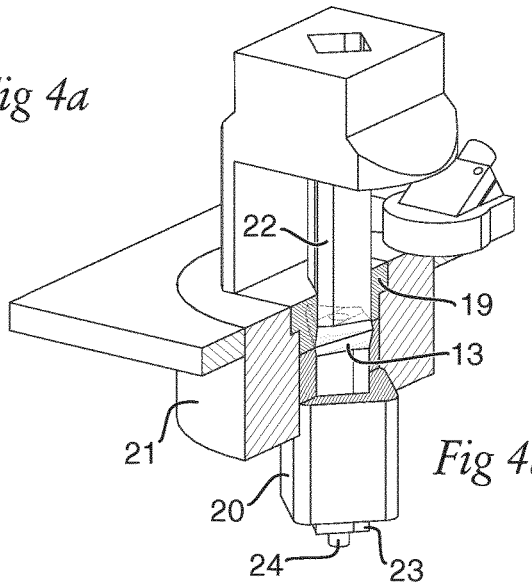
Figure 4C:
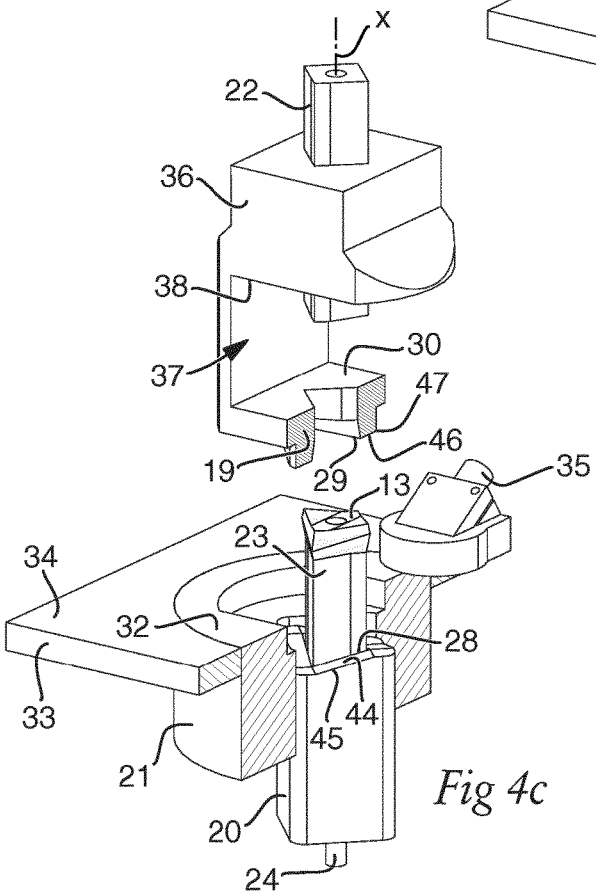
Figure 5A:
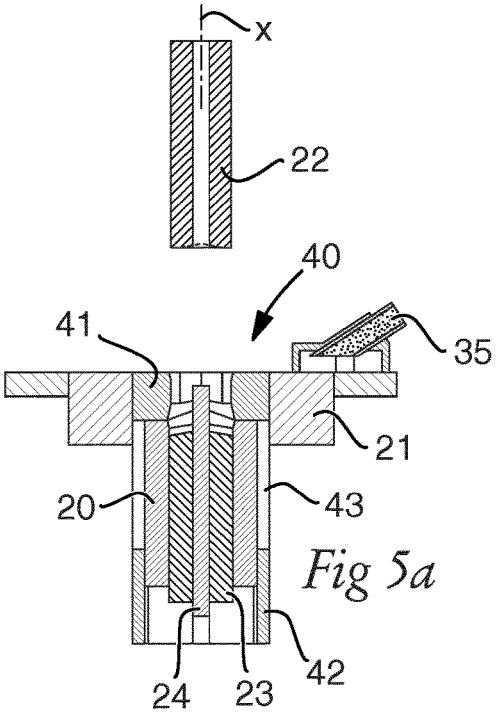
Figure 5B:
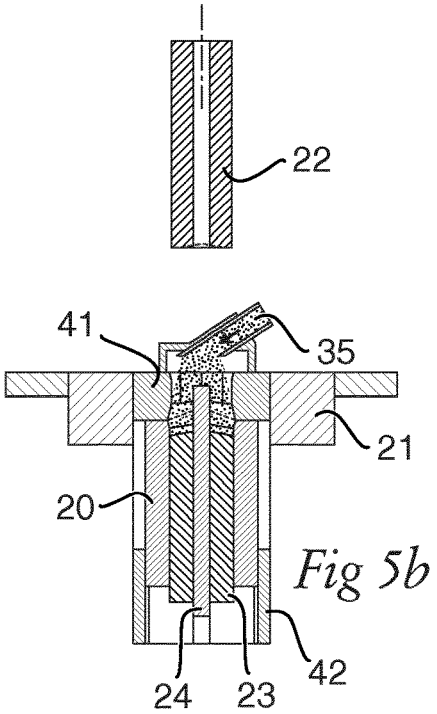
Figure 5C:
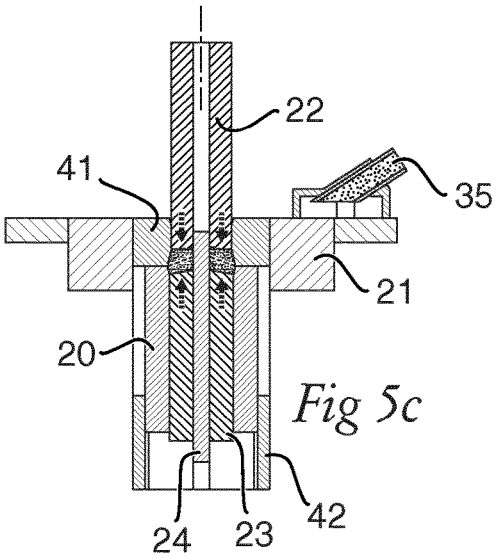
Figure 5D:
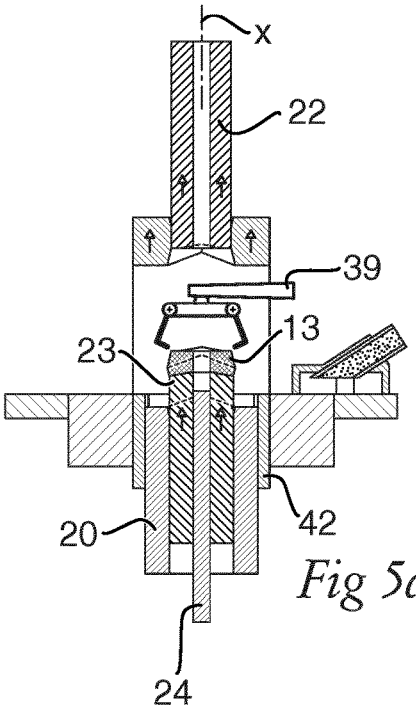

In FIG. 3*b*, the powder-filling device 35 is advanced through a sliding motion on the surfaces 30 and 32 of the upper die part 19 and the outer die part 21 respectively, to its powder-filling position on top the opening 31 in the upper surface 30 of the upper die part 19. Powder is filled into the die cavity defined by the inner peripheries of the upper die part 19 and the lower die part 20 and the upper end 26 of the lower punch 23. If the lower punch 23 is not already in a retracted position before this step, it is moved to such a position during this step, such that the cavity is enlarged relative the die cavity 25 that will define the geometry of the cutting insert green body in a later final compacting step (FIG. 3*f*). The die cavity is fully filled with powder. In other words, the upper powder level is in alignment with the upper surface 30 of the upper die part 19. The core pin 24 is held in a position in which it extends through the die cavity and in which its upper end is in alignment with the upper surface 30 of the upper die part 19.

Figure 3C:
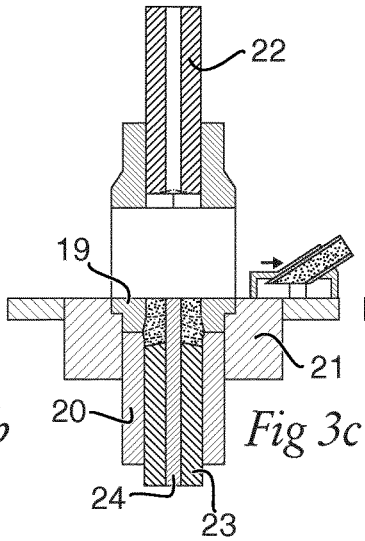

In FIG. 3*c*, the powder-filling mechanism 35 is retracted from the powder-filling position through a sliding motion in the opposite direction to which it was previously advanced.

Figure 3D:
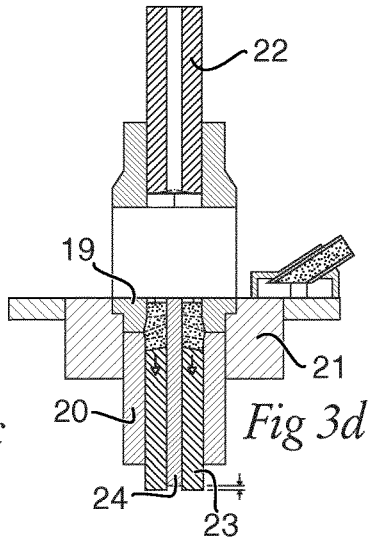

In FIG. 3*d*, a slight further retraction of the lower punch 23 is performed for the purpose of making some space for the upper punch 22 to enter into the upper die part 19 before starting to compact the powder in a subsequent powder-compacting step or to create wished press path ratios.

Figure 3E:
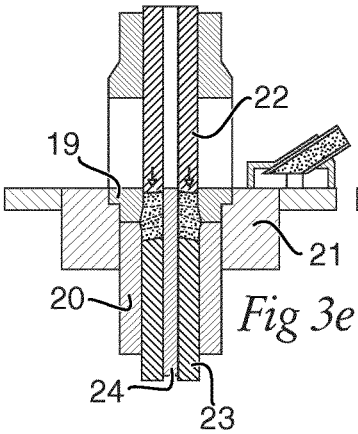

In FIG. 3*e*, the upper punch 22 is advanced to and into the opening 31 in the upper surface 30 of the upper die part 19.

In FIG. 3*f*, compaction is performed as the lower punch 23 is advanced to a final compaction position and the upper punch 22 is advanced to a final compaction position. In said final compaction position, the outer peripheral surface of the die cavity 25 that defines the geometry of the cutting insert green body 13 is defined by the inner peripheries of the upper die part 19 and the lower die part 20, and the upper end 26 of the lower punch 23 and the lower end 27 of the upper punch 22. A parting line 14 of the compacted cutting insert green body 13 is defined by the parting lined defined by the lower inner edge 29 of the upper die part 19 and the upper inner edge 28 of the lower die part 20. The parting line 14 extends around the cutting insert green body 13 where the latter presents its maximum width.

Figure 3G:
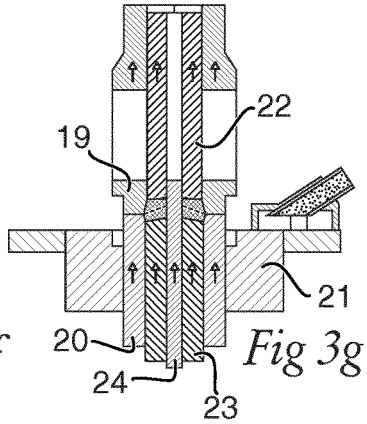

In FIG. 3*g*, the unit comprised by the upper die part 19, the lower die part 20, the upper punch 22, the lower punch 23 and the core pin 24 is moved upwards from the position shown in FIG. 3*f* to a level at which at least an upper end of the compacted cutting insert green body 13 is above the level of the upper surface 32 of the outer die part 21. Here, also a lower end of the compacted cutting insert green body 13 is above the level of the upper surface 32 of the outer die part 21. Thereby, a subsequent removal of the cutting insert green body 13 from the compacting machine is facilitated.

Figure 3H:
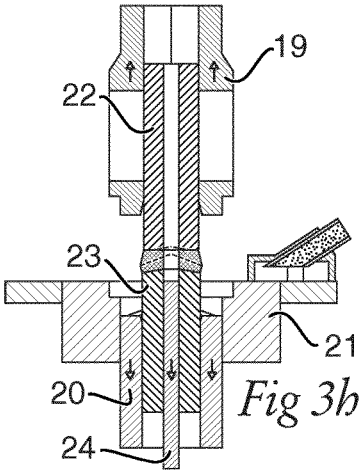

In FIG. 3*h*, the lower die 20 and the core pin 24 are retracted downwards to a level at which neither of these does engage with the compacted cutting insert green body 13. The upper die part 19 is retracted upwards such that it does not engage with the compacted cutting insert green body 13, which is now fully exposed and held only by, and between, the lower punch 23 and the upper punch 22.

Figure 3I:
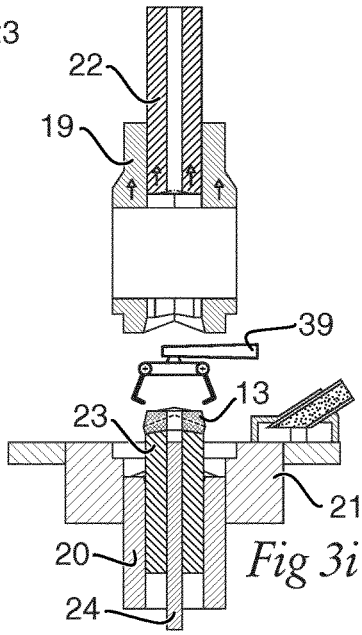

In FIG. 3*i*, the upper punch 22 is retracted further, as well as a the upper die part 19, such that the compacted cutting insert green body 13 is only supported by the upper end 26 of the lower punch 23. A removal device 39, such as a robot arm or the like, equipped with a gripping device, is arranged to grip and remove the green body 13 from its position on top of the lower punch 23.

FIGS. 5*a*-5*d* show different steps during a compaction sequence for an alternative embodiment of a compaction device according to the invention. The compaction device shown in FIGS. 5*a*-5*d* differs from the one shown in FIGS. 3-4 in that it has a die 40 in which the upper die part 41 presents a lower extension 42 that extends laterally outside the lower die part 20, and that displacement of the upper die part 41 to or from the position in which it is joined with the lower die part 20 is enabled by action on and displacement of the lower extension 42 of the upper die part 41 in a direction parallel with the pressing axis x. Preferably, the lower extension 42 of the upper die part 41 is connected to an actuator, not shown, for performing the motion of the upper die part 41. The actuator is suitably located below the die 40.

In order to allow a removal device 39 to remove the compacted cutting insert green body 13 after compaction thereof, the lower extension 42 of the upper die part 41 comprises a lateral opening 43 which is exposed when the upper die part 41 is retracted from the position in which it is joined with the lower die part 20, such that a compacted green body 13, which is exposed as a result of said retraction of the upper die part 41, is laterally exposed through said opening 43.

Figure 6:
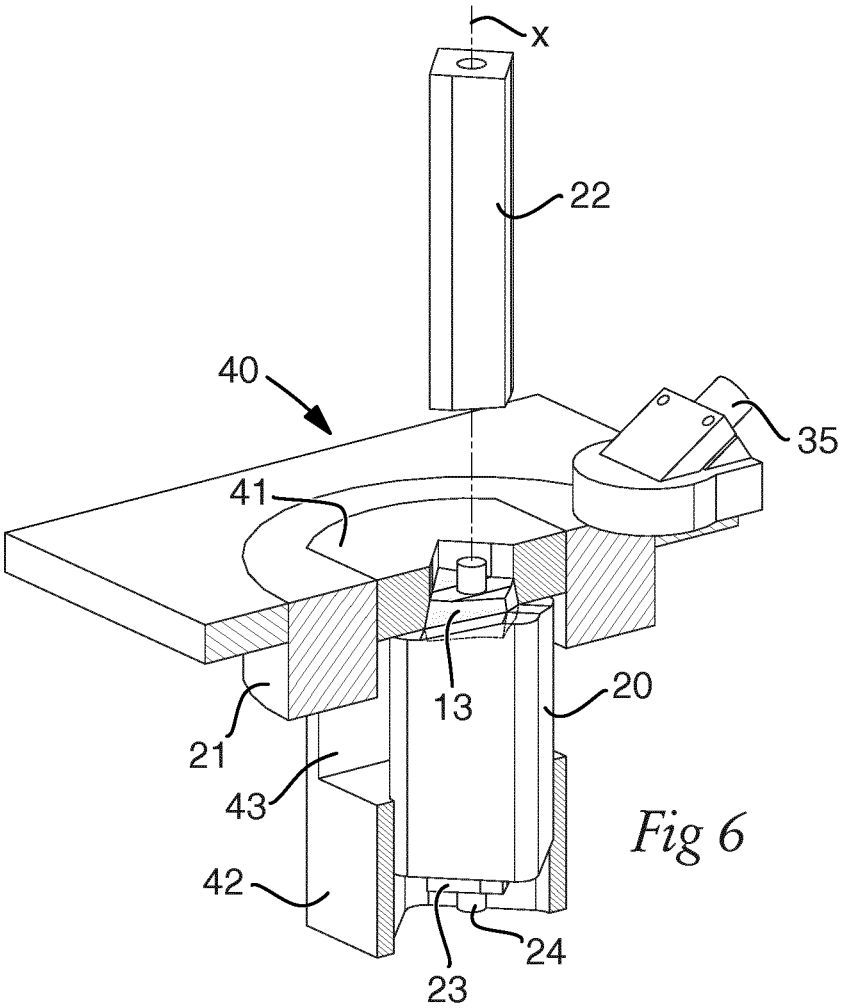
FIG. 6 is a perspective view of the embodiment shown in FIGS. 5*a*-5*d*, in a position after compaction of a cutting insert green body.

FIG. 6 is a further representation, by means of a perspective view, of the embodiment shown in FIGS. 5*a*-5*d*, in a position after compaction of a cutting insert green body 13. The upper punch 22 is in a retracted position. In order to obtain the position shown in 5*d*, the upper die part should be retracted upwards from the position in which it is joined with the lower die part 20 and the lower punch 23 should also be displaced upwards in relation to the lower die part 20 and the outer die part 21 in order to make the compacted green body 13 accessible for a removal device.

The invention claimed is:

1. A method of compacting a powder into a cutting insert green body, such that said cutting insert green body obtains a barrel-shape having a parting line on an outer peripheral surface thereof, which is at least partially non-perpendicular to a pressing axis along which said compacting is performed, said method comprising the steps of:

providing a compaction tool including a die having an upper die part, a lower die part, an upper punch and a lower punch, wherein the upper and lower die parts, when joined together, define a die cavity that is delimited by an inner peripheral surface that defines the shape of the outer peripheral surface of the barrel-shaped green body to be formed by said compaction;

providing at least one of the lower die part and the upper die part with a pressing bore extending from said die cavity, for receiving the lower punch or the upper punch in connection with said compacting;

providing the lower die part with an upper inner edge that extends along a line defining the parting line of the green body;

providing the upper die part with a lower inner edge that extends along a line defining the parting line of the green body;

providing the upper die part with an upper surface that, at least in one direction, extends rectilinearly;

providing the upper die part with an upper opening in said upper surface, through which the upper punch is arranged to be forwarded into said cavity;

positioning the upper die part above the lower die part such that the lower inner edge of the upper die part is contiguously arranged in relation to the upper inner edge of the lower die part;

positioning the upper punch in a retracted position relative the upper opening of the upper die part;

filling powder into the die through said upper opening in the upper surface of the upper die part;

compacting the powder by forwarding at least the upper punch towards said cavity;

retracting the upper punch; and exposing the green body by retracting the upper die part from the lower die part.

2. The method according to claim 1, further comprising the step of providing a powder-filling device and positioning it on top of said upper opening in the upper die part or removing it from said position by permitting it to slide on said upper surface of the upper die part in said direction in which said surface extends rectilinearly.

3. The method according to claim 2, wherein the upper die part is retracted from the lower die part through a rectilinear motion in the direction of the pressing axis.

4. A device for manufacturing a cutting insert green body by compacting a powder, said device comprising:

a die including an upper die part and a lower die part that are separable from each other, an upper punch, and a lower punch, at least one of which is moveable along a pressing axis in relation to the die, wherein the upper and lower die parts, when joined, define a die cavity that is delimited by an inner peripheral surface that defines the shape of the outer peripheral surface of the green body to be formed by said compaction, and wherein said inner peripheral surface of the die cavity is arranged such that the green body obtains a barrel-shape having a parting line on the outer peripheral surface thereof which at least partially is non-perpendicular to said pressing axis, and wherein at least one of the lower die part and the upper die part has a pressing bore extending from said cavity, for the lower punch and upper punch respectively to be received in the device;

the lower die part having an upper inner edge that extends along a line defining the parting line of the green body;

the upper die part having a lower inner edge that extends along a line defining the parting line of the green body;

the upper die part having an upper surface that, at least in one direction, extends rectilinearly; and the upper die having an upper opening in said upper surface, through which the upper punch is arranged to be forwarded into said cavity.

5. The device according to claim 4, wherein the lower die part has an upper surface, which is delimited by said upper inner edge and which, from a centre axis of said cavity parallel with the pressing axis, extends in a lateral direction from said upper inner edge, the upper die part having a lower surface which is delimited by said lower inner edge thereof and which, from said centre axis, extends in a lateral direction, wherein at least parts of the upper surface of the lower die part and the lower surface of the upper die part are in bearing contact with each other when the upper and lower die parts are joined and the lower inner edge of the upper die part and the upper inner edge of the lower die part are contiguously arranged in relation to each other and the inner cavity is defined.

6. The device according to claim 5, wherein said upper and lower surfaces have corresponding extensions and are in bearing contact with each other along a whole area thereof when the upper and lower die parts are joined and the lower inner edge of the upper die part and the upper inner edge of the lower die part are contiguously arranged in relation to each other and the inner cavity is defined.

7. The device according to claim 4, wherein the upper surface of the upper die part is flat.

8. The device according to claim 7, wherein the upper surface of the upper die part extends in a plane perpendicular to the pressing axis.

9. The device according to claim 4, wherein the die includes an outer die part that laterally encloses the upper and lower die parts when the upper and lower die parts are joined.

10. The device according to claim 9, wherein the outer die part has an upper surface that is arranged so as to coincide with the upper surface of the upper die part when the latter is joined with the lower die part and the device is set for filling of powder into said die cavity.

11. The device according to claim 9, wherein the upper die part is displaceable in the direction of the pressing axis in relation to the outer die part.

12. The device according to claim 4, further comprising a powder-filling device arranged to slide on said upper surface of the upper die part in said least one direction in which the upper surface extends rectilinearly to and from a powder-filling position on top of said upper opening of the upper die part.

13. The device according to claim 4, wherein the upper die part presents an extension which is connected to an actuator such that a displacement of the upper die part in the direction of the pressing axis is enabled.

14. The device according to claim 4, wherein the cutting insert green body, the outer peripheral surface of which is defined by the inner peripheral surface of the die cavity, presents an upper end, a lower end and a waist between said upper end and lower end, and that, in at least one radial direction as seen from a centre axis of the cutting insert green body, the waist has a lateral extension that is larger than the corresponding lateral extension of the cutting insert green body anywhere from the waist to the upper end of the cutting insert green body and anywhere from the waist to the lower end of the cutting insert green body.

* * * * *